US005319343A

United States Patent [19]

Jeffries

[11] Patent Number: 5,319,343

[45] Date of Patent: Jun. 7, 1994

[54] INTEGRATED MAGNETIC INDUCTOR HAVING SERIES AND COMMON MODE WINDINGS

[75] Inventor: Paul A. Jeffries, Plano, Tex.

[73] Assignee: Powercube Corporation, Billerica, Mass.

[21] Appl. No.: 570,522

[22] Filed: Aug. 21, 1990

[51] Int. Cl.[5] ..... H01F 27/28

[52] U.S. Cl. ..... 336/181; 333/181; 336/184

[58] Field of Search ..... 333/181, 177, 185, 12, 333/4; 336/171, 181, 184, 221, 229; 323/355

[56] References Cited

U.S. PATENT DOCUMENTS

| | | | |
|---|---|---|---|
| 1,553,983 | 9/1925 | Casper | 336/184 X |
| 3,231,841 | 1/1966 | Ohtake | 336/184 X |
| 3,629,741 | 12/1971 | Brune | 333/177 |
| 3,631,534 | 12/1971 | Hirota et al. | 336/184 X |
| 3,683,271 | 8/1972 | Kobayashi | 336/181 X |
| 3,753,189 | 8/1973 | Allen | 336/171 |
| 3,778,759 | 12/1973 | Carroll | 333/12 X |
| 4,581,573 | 4/1986 | Dobsa et al. | 323/356 |
| 5,023,585 | 6/1991 | Kurano et al. | 333/181 X |
| 5,083,101 | 1/1992 | Frederick | 333/12 X |

FOREIGN PATENT DOCUMENTS

| | | | |
|---|---|---|---|
| 15245/88 | 2/1990 | Australia . | |
| 211905 | 4/1960 | Austria | 336/184 |
| 3526047 | 1/1987 | Fed. Rep. of Germany | 333/181 |
| 71156 | 6/1977 | Japan | 336/181 |
| 14536 | 2/1978 | Japan | 333/181 |
| 64813 | 4/1983 | Japan | 333/181 |
| 81320 | 5/1983 | Japan | 333/181 |
| 81321 | 5/1983 | Japan | 333/181 |
| 261907 | 10/1988 | Japan | 333/181 |
| WO87/00997 | 2/1987 | PCT Int'l Appl. . | |
| 706887 | 12/1979 | U.S.S.R. | 336/181 |

OTHER PUBLICATIONS

"MU-Derived Communications Filter", *Research Disclosure*, Oct. 1986, p. 611.

*Primary Examiner*—Benny Lee

*Attorney, Agent, or Firm*—Ross, Howison, Clapp & Korn

[57] ABSTRACT

An integrated magnetic filter inductor having series and common mode windings includes a magnetic core (44) having a first leg (46), a second leg (48), and a third leg (50). The first leg (46) is connected to the second leg (48) with bridging structures (52) and (54). In a similar manner, the third leg (50) is connected to the second leg (48) with bridging structures (56) and (58). A common mode winding (64) is wound about the bridging structure (52) with a given dot orientation. A common mode winding (66) is wound about the other bridging structure (54) with the same dot polarity. Current flowing into the dot terminal of the common mode winding (64) and out of the dot terminal of the common mode winding (66) result in a net zero magnetic flux induced in the magnetic structure (44). A common mode winding (68) is wound about the bridging structure (56) with a predetermined dot polarity. A common mode winding (70) is wound about the other bridging structure (58) with the same dot polarity. Therefore, when current flows into the dot end of one of the windings (68) and (70) and out of the dot end of the other winding, the net flux induced in the magnetic structure (44) is zero. A primary winding (62) is wound about the second leg and induces a flux into the magnetic structure (44).

9 Claims, 2 Drawing Sheets

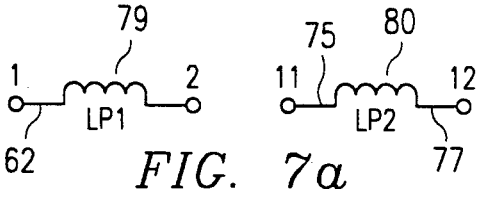
FIG. 7a
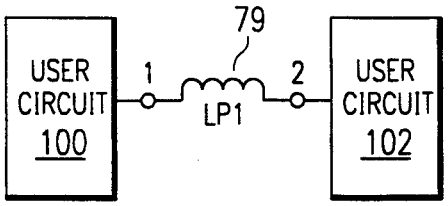
FIG. 8a
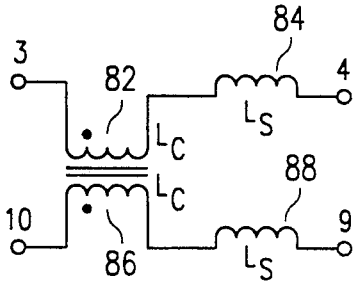
FIG. 7b
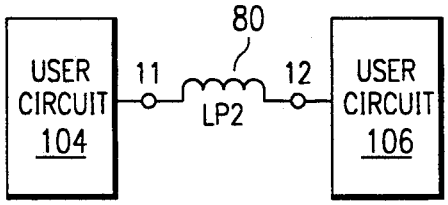
FIG. 8b
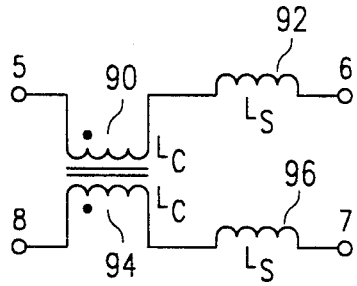
FIG. 7c
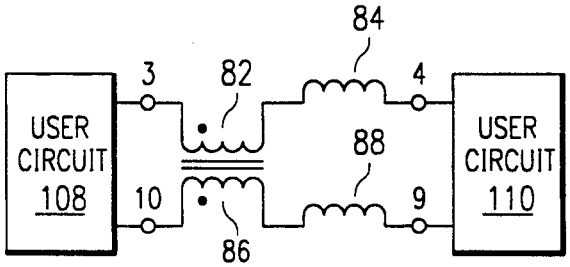
FIG. 8c
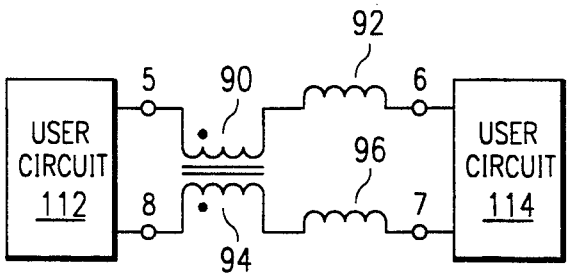
FIG. 8d
FIG. 9a
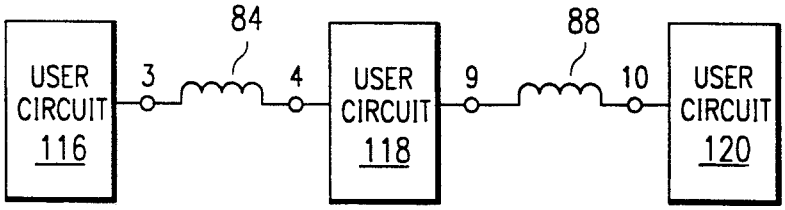
FIG. 9b
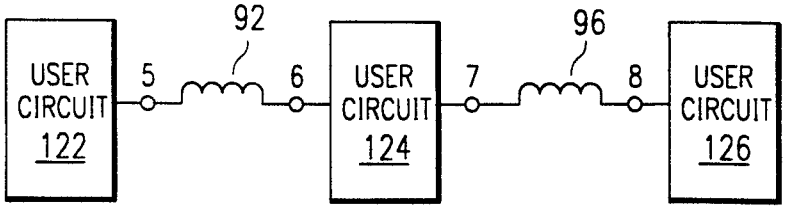

INTEGRATED MAGNETIC INDUCTOR HAVING SERIES AND COMMON MODE WINDINGS

TECHNICAL FIELD OF THE INVENTION

The present invention pertains in general to magnetic filter inductors and, more particularly, to a multiple series and common mode inductor device for use in linear or switching power supply applications.

BACKGROUND OF THE INVENTION

Filter inductors have seen widespread use in linear and switching power supplies. Low pass filters are required in almost every power conversion application to reduce input and output ripple currents of a power supply. In linear converters where sinusoidal AC inputs are rectified to various DC levels, low-pass filters are required to prevent the undesired AC components from appearing at the output terminals of the converter. In switching power supply converters the inductor requirements are even greater. In addition to the low-pass filter requirements of the switching converter, inductors are used to store and transfer energy, and to block or reduce large current pulses during each switching cycle. All switching power supply converters switch a DC voltage at a relatively high frequency, transform the signal, then rectify the high frequency AC to a DC output. As a result of the high frequency switching and large current pulsing, Electromagnetic Interference (EMI) filters are required to block voltage spikes, switching harmonics, and associated noises generated within the switching converter. EMI filters are also required to reduce susceptibility problems due to conducted and radiated interferences from the outside world.

Typically, a low-pass or EMI filter consists of some type of series inductance and associated shunt capacitance. The series inductance must have the characteristics of a high value of inductance with a low series resistance, resulting in a relatively low power loss for the filter. A filter may also consist of multiple series and common mode inductance stages separated by shunt capacitance between each stage for maximum low-pass and EMI filtering of a DC signal. In the past, this has been achieved by winding a single coil about a magnetic core for each discrete inductance requirement. Magnetic integration can be used to combine multiple series and common mode windings on a single magnetic core resulting in inductor designs of lower cost, size, weight and even improved efficiency.

SUMMARY OF THE INVENTION

The present invention disclosed and claimed herein comprises an integrated magnetic filter. The magnetic filter includes a magnetic core structure for providing a substantially enclosed magnetic path. A first common mode winding is wound about the magnetic path of the magnetic core and having an input and an output. A first leakage inductance is associated with the first common mode winding. A second common mode winding is wound about the magnetic path of the magnetic core with an input and an output. A second leakage inductance is associated with the second common mode winding. The first and second common mode windings are operable to offset the magnetic flux induced in the magnetic path when substantially identical and opposite currents are input to the first and second common mode windings.

In another aspect of the present invention, the first and second common mode windings can be disposed on a toroidal magnetic structure or on a rectangular magnetic structure such that they are disposed at diametrically opposite ends of the magnetic core structure to provide maximum leakage inductance between the first and second common mode windings.

In a yet further aspect of the present invention, the magnetic core structure includes first, second and third legs disposed parallel to each other with the second leg disposed between the first and third legs. The first and second legs are connected on either ends thereof by first and second bridging portions such that they are disposed a predetermined distance apart. In a similar manner, the second and third legs are connected at either ends thereof by third and fourth bridging portions, respectively. The first and second common mode windings are wound about the first and second bridging portions such that they are disposed a predetermined distance apart. A primary winding is provided that is disposed about the second leg wherein the inductance of the primary winding is isolated from all other inductances.

In a yet further aspect of the present invention, third and fourth windings are provided which are wound about the third and fourth bridging portions, respectively. Third and fourth leakage inductances are associated with the third and fourth common mode windings, respectively. The third and fourth common mode windings are operable to provide a substantially zero net flux in the magnetic structure when substantially identical and opposite currents are input thereto.

In a yet further aspect of the present invention, a second primary winding is wound about the first and third legs of the magnetic structure wherein the inductance of the second primary winding is magnetically isolated from all other inductances.

BRIEF DESCRIPTION OF THE DRAWINGS

For a more complete understanding of the present invention and the advantages thereof, reference is now made to the following description taken in conjunction with the accompanying Drawings in which:

FIGS. 7*a*–7*c* illustrate schematic diagrams of the inductive elements resulting from the configuration of FIG. 6;

FIGS. 8*a*–8*c* illustrate exemplary interconnection schemes; and

FIGS. 9*a* and 9*b* illustrate alternate interconnection schemes.

DETAILED DESCRIPTION OF THE INVENTION

Figure 1:
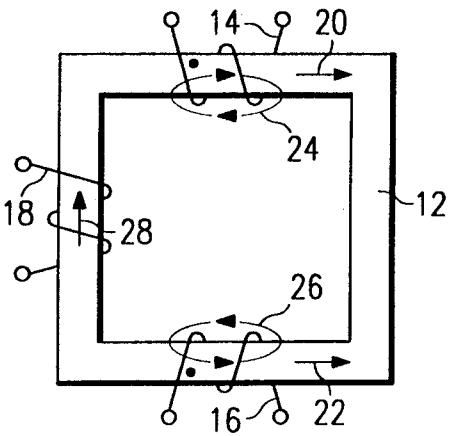
FIG. 1 illustrates a diagram of a magnetic core structure with two common mode windings and a primary winding disposed thereabout.

Referring now to FIG. 1, there is illustrated a diagram of one embodiment of the present invention. A rectangular shaped magnetic core 12 is provided that has four sides. Two common mode windings 14 and 16 are provided and a primary winding 18 is provided. The common mode windings 14 and 16 are wound about the core 12 such that the flux induced therethrough travels in the opposite direction. The winding orientation is represented by a "dot" on one end of the winding. It can be seen that the winding 14 and the winding 16 are wound such that the flux induced by winding 14 for current input to the "dot end" would be in a clockwise direction around the core 12, as represented by a flux arrow 20, and the flux induced by the winding 16 for current output from the "dot end" would be in a counter clockwise direction, as represented by a flux arrow 22.

If the current through each of the windings 14 and 16 were equal, the flux represented by flux arrows 20 and 22 would also be equal, thereby resulting in a cancellation of the flux therein. However, there will be a leakage flux or secondary flux associated with each of the common mode windings 14 and 16. The secondary flux for the winding 14 is represented by flux lines 24 and the secondary flux associated with the winding 16 is represented by flux lines 26. The secondary flux can be seen to occur outside of the magnetic structure. The flux lines 24 and the flux lines 26 are not coupled to each other. Flux lines 24 and 26, are coupled only with the associated winding that induced the leakage and do not link with any other winding. Thus, the primary winding is magnetically isolated from the secondary flux lines. It should be noted that the common mode windings 14 and 16 are disposed on the opposite sides of the magnetic structure 12 to provide the maximum secondary inductance possible. The leakage inductance which is purposely enhanced by the decoupling of the two common mode windings constitutes a very significant contributor to the total inductance of the filter. The decoupling of the common mode windings is an important aspect of the present invention, which is distinguished from the common practice of close coupling all windings. Since the secondary flux lines 24 and the secondary flux lines 26 are opposite in direction, the net flux in the magnetic structure 12 is zero. The only other flux that remains in the magnetic structure 12 is that induced by the primary winding 18. This flux is represented by a flux line 28. Since the net flux of the magnetic structure 12 due to the common mode windings is zero, the flux inducted by the common mode windings that link or couple with the primary winding 18 will also be zero. Therefore, the primary winding 18 is isolated magnetically from the common mode windings 14 and 16.

The flux arrow 28 representing the flux induced in the magnetic structure 12 by the primary winding 18 flows through the common mode windings 14 and 16. However, the common mode windings are connected in such a way that the effect that the primary flux has on one of the common mode windings 14 or 16 will be counteracted or cancelled by the other of the common mode windings 14 or 16, resulting in isolation of the common mode windings 14 and 16 from the primary winding 18.

Figure 2:
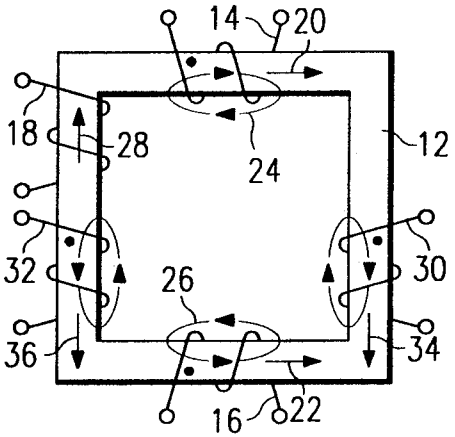
FIG. 2 illustrates a magnetic core structure with four common windings and a single primary winding.

Referring now to FIG. 2, there is illustrated an alternate embodiment of the structure of FIG. 1 incorporating a second set of common mode windings 30 and 32. The common mode windings 30 and 32 are disposed on opposite sides of the magnetic structure 12 to maximize 32 operate similar to the common mode windings 14 and 16, having secondary flux lines 24 and 26, respectively, with common mode winding 30 inducing a flux, represented by flux arrow 34, in one direction with common mode winding 32 inducing a flux, represented by flux arrow 36, in the opposite direction. The flux induced by the common mode windings 30 and 32 cancels with each other such that they are isolated from the other windings and, since the flux is in the opposite direction, it provides a net flux of zero in the entire magnetic structure 12. It is important to note that for the net flux to be zero, the current flowing through each of the common mode windings 30 or 32 or each of the common mode windings 14 and 16 must be equal.

Figure 3:
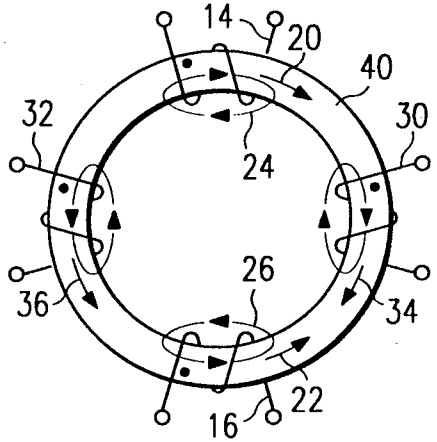
FIG. 3 illustrates an alternate embodiment of the structure of FIG. 2 utilizing a toroidal magnetic core structure.

Referring now to FIG. 3, there is illustrated an alternate embodiment of the structure of FIG. 2 utilizing a toroidal magnetic structure 40. For simplicity purposes the primary winding 18 is not illustrated. The toroidal structure has the windings 14 and 16 and the windings 30 and 32 disposed thereon in such a manner that they are diametrically opposed to each other with the windings 30 and 32 disposed intermediate to the windings 14 and 16 on the toroidal structure 40. It should be noted that windings 18, 30, and 32 could be eliminated leaving only windings 14 and 16. The embodiment illustrated would then consist of two common mode windings and two secondary inductors. This would illustrate the simplest form of this aspect of the invention in which decoupling of the common mode inductor has added a significant amount of series inductance to the common mode windings. The common mode inductance will essentially be the same as for a conventional common mode inductor but the effectiveness of the filter will be greatly increased by the additional series inductance. It is also important to note that there are no additional power losses associated with the secondary inductance since no additional windings are required.

Figure 4:
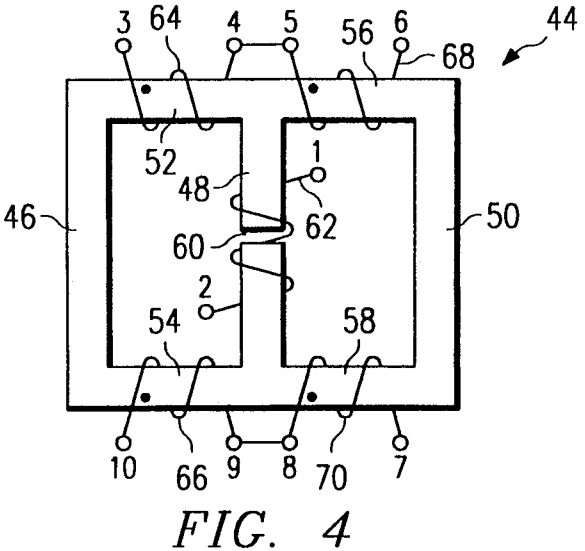
FIG. 4 illustrates a magnetic core structure having first, second and third legs with common windings disposed on the first and third leg and a primary winding disposed on the second leg.

Referring now to FIG. 4, there is illustrated an alternate embodiment of the present invention utilizing a magnetic structure 44 having a first leg 46, a second leg 48 and a third leg 50. The first leg 46, second leg 48 and third leg 50 are disposed parallel to each other with the first leg 46 connected to the second leg 48 with a bridging portion 52 and a bridging portion 54, disposed on opposite ends thereof. In a similar manner, the third leg 50 and the second leg 48 are interconnected by a bridging portion 56 and a bridging portion 58 on either end thereof. Second leg 48 may include a gap 60. This is a conventional magnetic structure.

A primary winding 62 is disposed about the second leg and has the inputs thereof labeled "1" and "2", this providing a first primary winding. A first common mode winding is provided with a winding 64 disposed on the bridging portion 52 and a winding 66 wound about the bridging portion 54. The dot orientation of the winding 64 is disposed toward the first leg 46 and the dot orientation of the winding 66 is disposed toward the first leg 46, and the windings are connected such that the flux induced by windings 64 and 66 in the first leg will be zero. The winding 64 has an input labeled "3" on the dot oriented side thereof and an output labeled "4" on the other side thereof. In a similar manner, the winding 66 has an output terminal "10" on the dot oriented side thereof and an input terminal "9" on the other side thereof.

The bridging portion 56 has a winding 68 disposed thereon with the dot orientation thereof disposed proximate the second leg 48. Winding 68 has an input terminal "5" on the dot oriented side thereof and an output terminal "6" on the other end thereof. A winding 70 is disposed on the bridging portion 58 with the dot orientation thereof disposed proximate the second leg. Winding 70 has an output terminal "8" on the dot oriented side thereof and an input terminal "7" on the other end thereof.

The windings 64 and 66 comprise one set of common mode windings and the windings 68 and 70 comprise a second set of common mode windings. Therefore, the primary winding 62 induces a flux that is split up between the first and third legs 46 and 50 at one end of the second leg 48 and is combined at the other end of the second leg 48. The common mode windings 64 and 66 and the common mode windings 68 and 70 are connected such that the effect the primary flux has on either of the common mode windings will be counteracted in the leg on which the common mode windings are disposed, and thus the net coupling effect of the primary flux to the common mode windings on the first leg 46 or on the third leg 50 will be zero through the magnetic structure 44.

The net flux induced in the first leg 46 of the magnetic structure 44 due to current flowing through the common mode windings 64 or 66 will be zero. The leakage flux or secondary flux that is associated with the common mode winding that induced it remains. The only other flux that remains in the first leg 46 will be flux induced by the primary winding 62. Since the net flux of the first leg 46 due to the common mode windings 64 and 66 is zero, the flux induced by the common mode windings 64 and 66 that couple with the primary winding 62 on the second leg 48 will also be zero. For the same reasons, the net flux induced by the common mode windings 68 and 70 on the third leg 50 will be zero, and the net flux induced by the common mode windings 68 and 70 on the third leg 50 that couples with the primary winding 62 on the second leg 48 will also be zero. Thus, it can be stated that the primary windings 62 on the second leg 48 and the common mode windings 64 and 66 on the first leg and the common mode windings 68 and 70 on the third leg 50 are magnetically isolated from one another.

As was the case described above, each of the common mode windings 64, 66, 68 and 70 has a secondary flux associated therewith, which secondary flux couples only with the associated winding that induced it and does not couple with either the primary winding 62 in the second leg 48 or any of the other common mode windings. Thus, it can be stated that the secondary inductors that are associated with each of the common mode windings 64, 66, 68 and 70 and the inductance of the primary winding 62 are magnetically isolated from one another.

Figure 5:
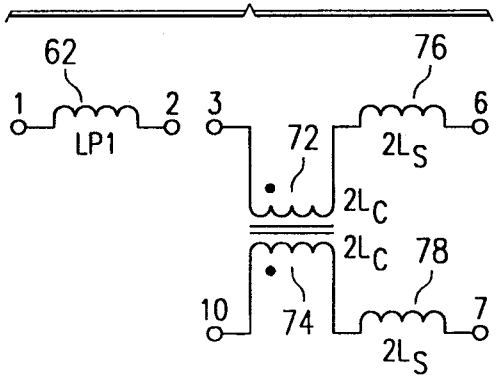
FIG. 5 illustrates a schematic diagram showing one interconnection of the inductors of FIG. 4.

Referring now to FIG. 5, there is illustrated a simplified schematic diagram of one configuration that the structure of FIG. 4 can be utilized in. For this connection, the terminal 4 of winding 64 and the terminal 5 of winding 68 are connected together and the terminal 9 of winding 66 and the terminal 8 of winding 70 are connected together. A first inductor LP1 is formed between terminals 1 and 2 of the primary winding 62. The common mode windings 64 and 68 provide one side 72 of a common mode structure and the common mode windings 66 and 70 provide another side 74 of the common mode structure. The terminals 3 and 10 comprise the two inputs to the common mode structure. The common mode inductance on each side of the common mode structure that results is greater than twice the single common mode inductance $L_c$. The top of each leg has a separate and isolated series inductance, 76 and 78, respectively, on either terminal 6 or terminal 7. Each of the series inductances represents twice the series inductance of one of the common mode windings 64, 66, 68 or 70, or $2L_s$. It should be noted that the primary inductance LP1 and the common mode inductors $2L_c$ and the series inductors $2L_s$ are isolated from each other but are configured on the same magnetic structure.

Figure 6:
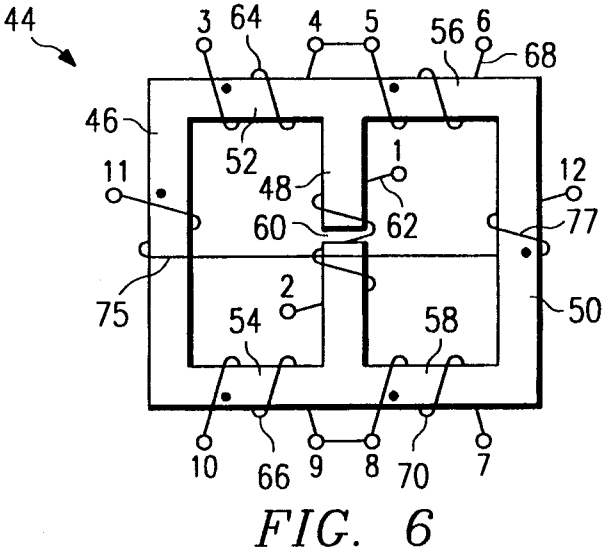
FIG. 6 illustrates the embodiment of FIG. 4 and implementing a second primary winding on the first and third legs.

Referring now to FIG. 6, there is illustrated an alternate embodiment of the structure of FIG. 4. In the embodiment of FIG. 6, a second primary winding is provided. The second primary winding is comprised of a first winding 75 that is wound on the first leg 46 and a second winding 77 that is wound on the third leg 50. The first winding 75 has one side thereof connected to a terminal 11 and wound about the first leg 46 such the terminal 11 is dot oriented and is represented by a "dot". The other end of the winding 75 is connected to one end of the winding 77. The winding 77 is oriented such that the other end of the winding 75 is connected to the dot oriented end of the winding 77 and is represented by a "dot". The other end of the winding 77 is connected to an input terminal 12. It should be noted that the second primary winding is wound such that the flux induced in the first leg 46 adds to the flux in the third leg 50, and the net flux in the second leg induced by the second primary winding is zero. The secondary winding operates such that it is magnetically isolated from the primary winding 62. Since the first primary winding 62 induces a flux downward in both the first leg 46 and the third leg 50, the net flux effect resulting between the first primary winding 62 and the second primary windings 75 and 77 is zero.

Referring now to FIGS. *7a–7c*, there are illustrated schematic diagrams of the basic configurations available in the structure of FIG. 6. The first primary winding 62 and the second primary windings 75 and 77 are illustrated in FIG. *7a*. The inductance provided between terminal 1 and terminal 2 provides an inductance 79 labeled LP1. The second primary windings 75 and 77 combine to form an inductance 80 between terminals 11 and 12 labeled LP2.

In FIG. *7b*, the series and common mode inductance between terminals 3 and 4 and terminals 9 and 10 is illustrated. The common mode inductance between terminals 3 and 4 is illustrated by an inductance 82 labeled $L_c$ and the series inductance in that leg is illustrated by a series inductance 84 labeled $L_s$. In a similar manner, the common mode inductance between terminals 9 and 10 is illustrated by an inductance 86 labeled $L_c$ and a series inductance 88 labeled $L_s$. It is important to note that the common mode inductances 82 and 86 are coupled but the associated series inductances 84 and 88 are isolated therefrom. Therefore, the series inductance 88 is magnetically isolated from the series inductance 84, even though they are on the same magnetic structure.

FIG. *7c* illustrates a schematic diagram for the common mode inductance and associated series inductance provided by the common mode windings 68 and 70. The common mode inductance between terminals 5 and 6 is illustrated by common mode inductance 90 labeled $L_c$ and the series inductance therebetween is illustrated by a series inductance 92 labeled $L_s$. The common mode inductance between terminals 8 and 7 is illustrated by a common mode inductance 94 labeled $L_c$, the series inductance illustrated by a series inductance 96 labeled $L_s$. It can be seen that six windings have provided a total of ten inductors on the same structure, each of the inductors magnetically isolated from the other.

Referring to FIGS. 8a–8d, there are illustrated user configurations for interconnecting the inductors provided by the structure of FIG. 6 as filters in various applications. In FIG. 8a, the inductor 79 labeled LP1 between terminals 1 and 2 is connected between a user circuit 100 and a user circuit 102. In FIG. 8b, the inductor 80 labeled LP2 between terminals 11 and 12 is connected between user circuits 104 and 106. In FIG. 8c, the differential output of a user circuit 108 is connected between terminals 3 and 10 to common mode inductors 82 and 86 and user circuit 110 has the differential inputs thereof connected to terminals 4 and 9 and series inductance 84 and 88, respectively. In FIG. 8d, a user circuit 112 has the differential outputs thereof connected to terminals 5 and 8 of common mode inductors 90 and 94, respectively. A user circuit 114 has the inputs thereof connected to terminals 6 and 7 on the output of series inductors 92 and 96, respectively. All of the user circuits 100–114 operate on filter components that are fabricated on a single magnetic structure but are magnetically isolated from each other.

Referring now to FIGS. 9a–9b, there is illustrated an alternate connection utilizing only the series inductance resulting from the leakage inductance. User circuit 116 (FIG. 9a) is connected to input terminal 3 of winding 64 (FIG. 6) and user circuit 118 is connected to terminal 4, (FIG. 6) thereby utilizing the series inductance 84. The circuit 118 is also connected to the input terminal 9 of the winding 66 (FIG. 6) and user circuit 120 is connected to the other terminal 10 of winding 66, thereby utilizing the series inductance 88 disposed therebetween. In a similar manner, a user circuit 1122 (FIG. 9b) is connected to terminals of the winding 68 (FIG. 6) and the user circuit 124 is connected to the terminal 6 of the winding 68, thereby utilizing the series inductance 92 disposed therebetween. The output of user circuit 124 is connected to terminal 7 of the winding 70 (FIG. 6), the terminal 8 connected to the user circuit 126, thereby utilizing the series inductance 96 disposed therebetween. In the circuits of FIGS. 9a and 9b, the series inductors 84, 88, 92 and 96 are isolated from each other although they are fabricated on a single magnetic structure.

In summary, there has been provided a filter circuit whereby a series of filter inductances are provided that are formed on a single magnetic structure yet they are isolated from one another. The filter elements are comprised of a combination of common mode inductances and series inductances. The common mode inductances are provided by two common mode windings that are disposed on a magnetic structure. The common mode inductance is comprised of two windings, each winding connected such that the flux induced in the magnetic structure by either of the common mode windings is cancelled out by the other of the common mode windings to provide a net flux of zero in the magnetic structure. Leakage inductance or secondary inductance is associated with each common mode winding and is coupled only to the winding which induced it. The leakage inductance is enhanced by the decoupling of the common mode winding and is a significant contributor to the overall series inductance of the filter. Two primary windings are provided for the magnetic structure and disposed between the two common mode windings. The usage of the invention is not limited to a low-pass or EMI filter. Since the windings of the invention are magnetically isolated from one another, they are independent and can be used for any function in various unrelated sections of a design for any given application.

Although the preferred embodiment has been described in detail, it should be understood that various changes, substitutions and alterations can be made therein without departing from the spirit and scope of the invention as defined by the appended claims.

What is claimed is:

1. An integrated magnetic inductor comprising:

a magnetic core structure for providing a substantially enclosed magnetic path, said magnetic core structure including:

a first leg, a second leg, and a third leg, said first, second, and third legs each having respective ends and being substantially parallel to each other;

first and second bridging portions for bridging one end of said second leg to one end of said first leg and the other end of said second leg to the other end of said first leg, respectively;

third and fourth bridging portions for connecting one end of said second leg to one end of said third leg and the other end of said first leg to the other end of said third leg, respectively;

a first winding wound about said magnetic path on said magnetic core structure for inducing a first magnetic flux in said magnetic core structure and having an input and an output;

a first leakage inductance associated with said first winding;

a second winding wound about said magnetic path on said magnetic core structure for inducing a second magnetic flux in said magnetic core structure and having an input and an output, said second winding being spaced apart a maximum distance from said first winding on said magnetic core structure;

a second leakage inductance associated with said second winding;

said first and second windings being disposed on said magnetic core structure such as to cancel said first and second magnetic flux;

said first winding disposed on said first bridging portion and said second winding disposed on said second bridging portion, respectively, to maximize said first and second leakage inductances; and a third winding wound about said second leg and having a third leakage inductance, wherein said third leakage inductance of said third winding in magnetically isolated from said first and second leakage inductances of said first and second windings.

2. The integrated magnetic inductor of claim 1 and further including:

a fourth winding wound about said third bridging portion, said fourth winding having an input and an output, said input thereof being connected to said output of said first winding;

a fourth leakage inductance associated with said fourth winding;

a fifth winding wound about said fourth bridging portion, said fifth winding having an input and an output, said input thereof being connected to said output of said second winding;

a fifth leakage inductance associated with said fifth winding; and said fourth and fifth windings for inducing a magnetic flux in said magnetic core structure in said magnetic path associated therewith.

3. The integrated magnetic inductor of claim 2 and further including a sixth winding having:

a first winding portion wound about said first leg and having an input on one end thereof and a connecting end on the other end thereof;

a second winding portion wound about said third leg and having an output on one end thereof and a connecting end on the other end thereof, said connecting end of said second winding portion and the connecting end of said first winding portion being connected together;

said first winding portion for inducing a magnetic flux in said first leg;

said second winding portion for inducing a magnetic flux in said third leg; and said sixth winding being magnetically isolated from said first, second, fourth, and fifth windings and the associated leakage inductances thereof and further magnetically isolated from said third winding.

4. An integrated magnetic inductor, comprising:

a magnetic core structure for providing a single closed magnetic flux path;

a first winding wound about said magnetic path on said magnetic core structure for inducing a first magnetic flux in said magnetic core structure and having an input and an output;

a first leakage inductance associated with said first winding;

a second winding wound about said magnetic path on said magnetic core structure for inducing a second magnetic flux in said magnetic core structure and having in input and an output;

a second leakage inductance associated with said second winding;

said first and second windings disposed on said magnetic core structure such as to cancel said first and second magnetic flux; and a third winding wound about said magnetic path on said magnetic core structure for inducing a third magnetic flux in said magnetic core structure, said third winding having a third leakage inductance associated therewith that is magnetically isolated from said first and second leakage inductances of said respective first and second windings, such that said third winding is magnetically isolated from said first and second windings.

5. The integrated magnetic inductor of claim 4 wherein said magnetic core structure is toroidal in shape.

6. The integrated magnetic inductor of claim 4 wherein said magnetic core structure is rectangular in shape.

7. An integrated magnetic inductor comprising: a magnetic core structure for providing a substantially enclosed magnetic path, said magnetic core structure including:

a first leg, a second leg, and a third leg, said first, second, and third legs each having respective ends and being substantially parallel to each other;

first and second bridging portions for bridging one end of said second leg to one end of said first leg and the other end of said second leg to the other end of said first leg, respectively;

third and forth bridging portions for connecting one end of said second leg to one end of said third leg and the other end of said first leg to the other end of said third leg, respectively;

a first winding wound about said magnetic path on said magnetic core structure for inducing a first magnetic flux in said magnetic core structure and having an input and an output;

a first leakage inductance associated with said first winding;

a second winding wound about said magnetic path on said magnetic core structure for inducing a second magnetic flux in said magnetic core structure and having an input and an output;

a second leakage inductance associated with said second winding;

said first and second windings being disposed on said magnetic core structure such as to cancel said first and second magnetic flux;

said first winding disposed on said first bridging portion and said second winding disposed on said second bridging portion, respectively; and a third winding wound about said magnetic path on said magnetic core structure for inducing a third magnetic flux in said magnetic core structure, said third winding having a third leakage inductance associated therewith that is magnetically isolated from said first and second leakage inductances of said respective first and second windings, such that said third winding is magnetically isolated from said first and second windings.

8. The integrated magnetic inductor of claim 7 and further including:

a fourth winding wound about said third bridging portion, said fourth winding having an input and an output, said input thereof being connected to said output of said first winding;

a fourth leakage inductance associated with said fourth winding;

a fifth winding wound about said fourth bridging portion, said fifth winding having an input and an output, said input thereof being connected to said output of said second winding;

a fifth leakage inductance associated with said fifth winding; and said fourth and fifth windings for inducing a magnetic flux in said magnetic core structure in said magnetic path associated therewith.

9. The integrated magnetic inductor of claim 8 and further including a sixth winding having:

a first winding portion wound about said first leg and having an input on one end thereof and a connecting end on the other end thereof;

a second winding portion wound about said third leg and having an output on one end thereof and a connecting end on the other end thereof, said connecting end of said second winding portion and the connecting end of said first winding portion being connected together;

said first winding portion for inducing a magnetic flux in said first leg;

said second winding portion for inducing a magnetic flux in said third leg; and said sixth winding being magnetically isolated from said first, second, fourth, and fifth windings and the associated leakage inductances thereof and also magnetically isolated from said third winding.

* * * * *